United States Patent [19]

Dyer

[11] 3,998,460

[45] Dec. 21, 1976

[54] VEHICLE RACING GAME APPARATUS

[75] Inventor: Robert Ford Dyer, Rancho Palos Verdes, Calif.

[73] Assignee: Mattel, Inc., Hawthorne, Calif.

[22] Filed: Feb. 3, 1976

[21] Appl. No.: 655,023

[52] U.S. Cl. ..... 273/86 D; 46/206; 46/202; 273/86 H

[51] Int. Cl.[2] ..... A63F 9/14

[58] Field of Search ..... 273/86 D, 86 H; 46/1 K, 46/202, 206; 104/60

[56] References Cited

UNITED STATES PATENTS

| | | | |
|---|---|---|---|
| 3,599,365 | 8/1971 | Carver et al. | 46/202 |
| 3,622,158 | 11/1971 | Tepper et al. | 273/86 D |
| 3,877,169 | 4/1975 | Munday et al. | 273/86 D X |

FOREIGN PATENTS OR APPLICATIONS

| | | | |
|---|---|---|---|
| 1,294,623 | 4/1962 | France | 46/202 |
| 882,269 | 11/1961 | United Kingdom | 273/86 D |
| 884,287 | 12/1961 | United Kingdom | 46/202 |
| 943,825 | 12/1963 | United Kingdom | 46/202 |

*Primary Examiner*—Anton O. Oechsle
*Attorney, Agent, or Firm*—John M. May; Stephen L. King; Max E. Shirk

[57] ABSTRACT

Two side-by-side tracks form a closed loop having a curve at each end; the tracks support vehicles each of which moves around the closed loop as a result of impulses supplied to it by an improved vehicle-propulsion device located entirely within one of the curves for manual actuation by a child-user, and characterized by a novel propulsion arm which tilts upwards into its operating position about a fulcrum in response to an actuating force transmitted by a flexible tape which also causes said arm to rotate horizontally about a shaft.

6 Claims, 9 Drawing Figures

10
12
14
16
18
20
22
24
26
28
30
32
34
36
38
40
42
44
46
48
50
52
54
56
58
60
62
64
66
68
70
72
74
76
78
80
82
84
86
88
90
100
102
104
105
106
108
110
112
116
122
124
126
128

110
221
114
100
200
256
244
6
234
202
9
9
6
220
126
240
244

VEHICLE RACING GAME APPARATUS

BACKGROUND OF THE INVENTION

The background of the invention will be set forth in two parts.

1. Field of the Invention

The present invention pertains generally to the field of vehicle racing games and more particularly to an improved propulsion system for propelling toy vehicles around a continuous track forming a closed loop.

2. Description of the Prior Art

The prior art known to applicant consists of a co-pending patent application now abandoned entitled Vehicle Racing Game Apparatus, Ser. No. 609,479, Marius Joseph Morin and Otto Leonhard Gabler, inventors, assigned to the same assignee as is the present application, as well as the prior art referenced therein.

SUMMARY OF THE INVENTION

The propulsion arm is rotatably mounted about a vertical shaft which in the illustrated embodiment of the present invention is located at the center of a semicircular portion of a simulated closed loop raceway. The arm is free to rock a vertical plane about a fulcrum located on a horizontal axis in the vicinity of the intersection of said vertical shaft and said horizontal surface. Said propulsion arm is also provided with a circumferential drum surface vertically displaced from said fulcrum.

Drive impulses originating from a rotatably mounted driving hub, also having a circumferential drum surface provided as part thereof, are transmitted to said propulsion arm by means of a drive tape having one end fastened to the circumferential drum associated with the driving hub and having its other end fastened to the circumferential drum surface associated with the propulsion arm.

In view of the fact that the propulsion arm drum surface is vertically displaced from said fulcrum, drive impulses transmitted by said tape will cause said arm not only to rotate about said shaft, but also to rock in a vertical plane into an operating position.

The end of the propulsion arm is provided with a vehicle engaging member which in the embodiment illustrated is normally located in a depression in the simulated raceway but which in response to the actuating impulses rises into the path of travel of a toy vehicle and makes contact with the rear thereof thereby transmitting said drive impulses to said vehicle and propelling same about said simulated raceway.

For a more complete understanding of the present invention, both respect to its construction and to its operation, reference is made to the appended drawings and the detailed description of the preferred embodiment which follows.

It should be noted that the embodiment illustrated is exemplary only and not meant to limit the scope of the present invention as defined by the appended claims.

DESCRIPTION OF THE PREFERRED EMBODIMENT

Figure 1:
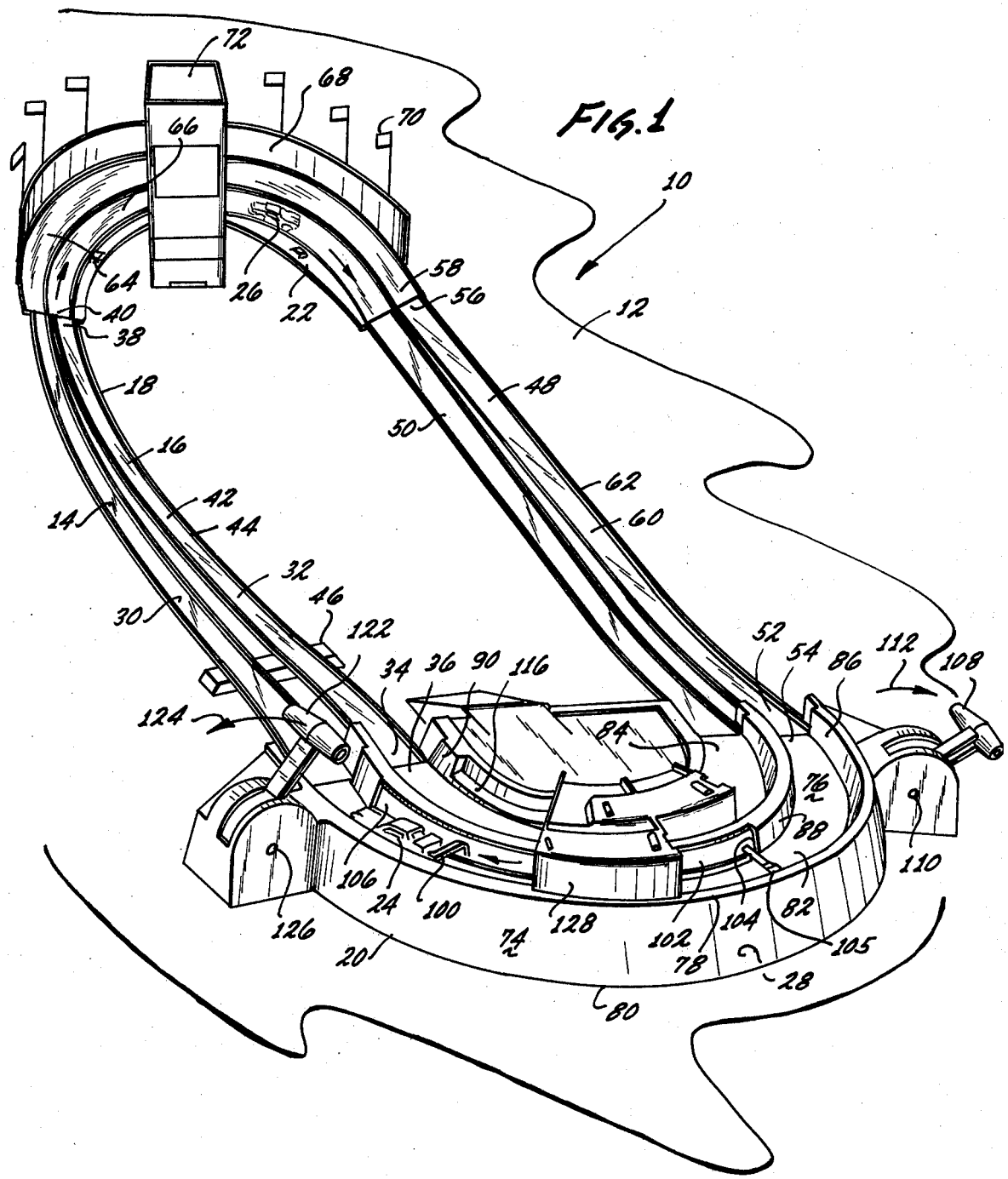
FIG. 1 is a perspective view of a vehicle racing game apparatus incorporating an embodiment of the present invention.

Referring again to the drawings, and more particularly to FIG. 1, a vehicle racing game apparatus constituting an embodiment of the present invention, generally designated 10, may be positioned on the floor of a child-user's room or other suitable supporting surface generally designated 12.

The vehicle racing game apparatus 10 may have a plurality of individual, side-by-side tracks upon which a plurality of toy vehicles may be run. The apparatus is shown herein for purposes of illustration, but not of limitation, as comprising two side-by-side tracks 14, 16 forming a closed loop 18 having a first curve 20 at one end and a second curve 22 at the other end. Tracks 14, 16 support toy vehicles 24, 26, respectively, each of which moves around the closed loop 18 as a result of impulses applied to it by a vehicle-propulsion device 28 located entirely within curve 20 for manual operation by a child-user.

The tracks 14, 16 include first track sections 30, 32 each having an upstream end 34 connected to the downstream end 36 of curve 20 and a downstream end 38 connected to the upstream end 40 of curve 22. Each track section 30, 32 includes a flat running surface 42 at each edge of which is an upstanding guide wall 44 adapted to guide vehicles 24, 26 along track sections 30, 32, respectively. Track sections 30, 32 may be extruded from a soft, pliable plastic material and may be supported intermediate their ends by a suitable block 46 to elevate the midportion of track sections 30, 32 above surface 12 to eliminate unwanted dips in the track sections and to ensure that the track surface 42 is relatively level in the vicinity of the exit portion (downstream end 36) of propulsion device 28 contained in curve 20. Tracks 14, 16 also include track sections 48, 50 each having a downstream end 52 connected to the upstream end 54 of curve 20 and an upstream end 56 connected to the downstream end 58 of curve 22. The track sections 48, 50 each also have a flat running surface 60 and upstanding guide walls 62.

Curve 22 includes a first banked section 64 forming part of track 14 and a second banked section 66 forming part of track 16. A simulated crash-barrier 68 may be provided on the end of curve 20 and may be made from cardboard, plastic or the like. Barrier 68 may be decorated with simulated flags 70, if desired. Additionally, a simulated observers stand 72 may be placed upon surface 12 adjacent curve 22.

Figure 2:
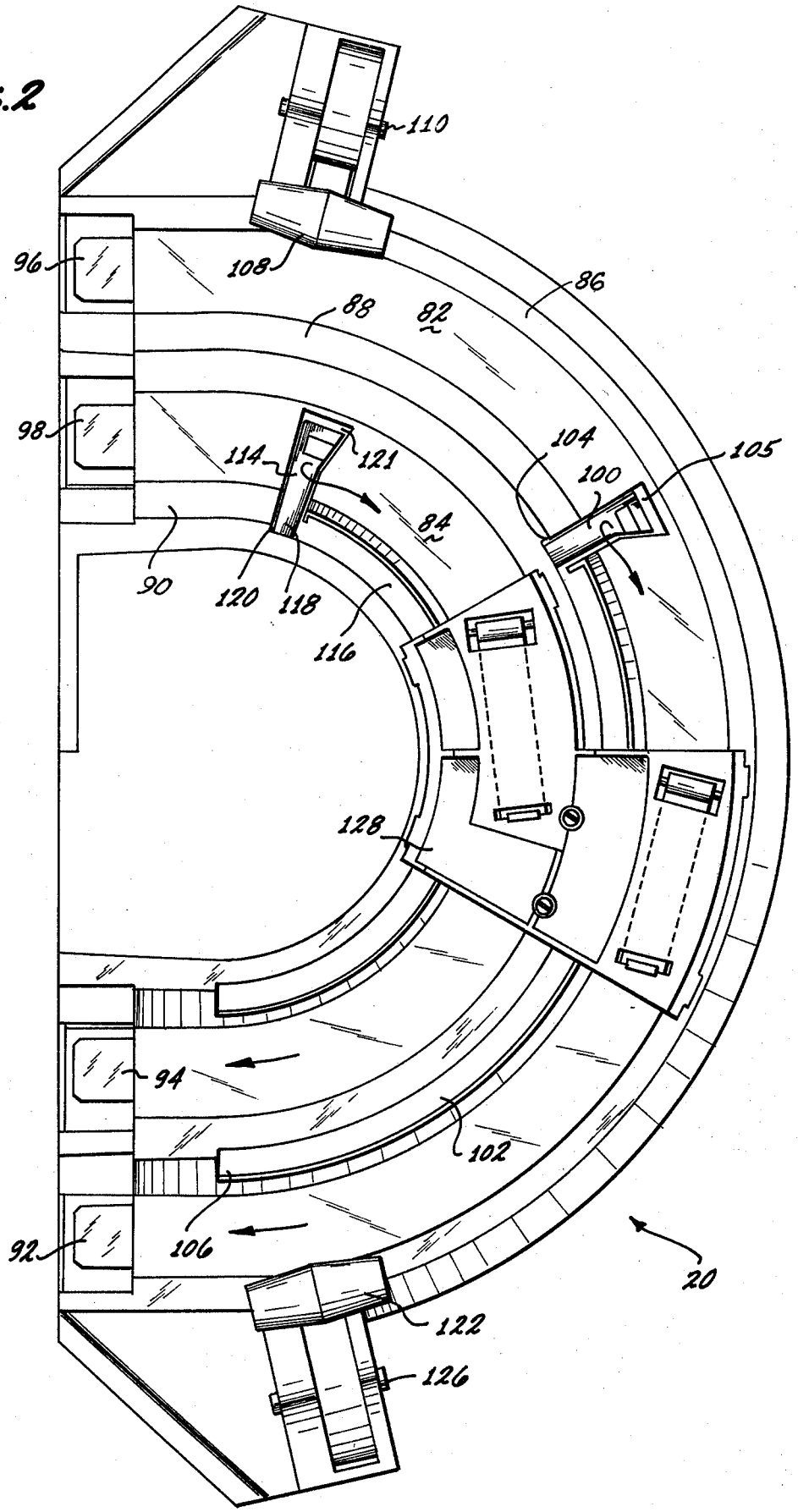
FIG. 2 is an enlarged, partial plan view of the apparatus of FIG. 1 showing an embodiment of the improved propulsion device of the present invention located entirely within one of the curves shown in FIG. 1.
Figure 3:
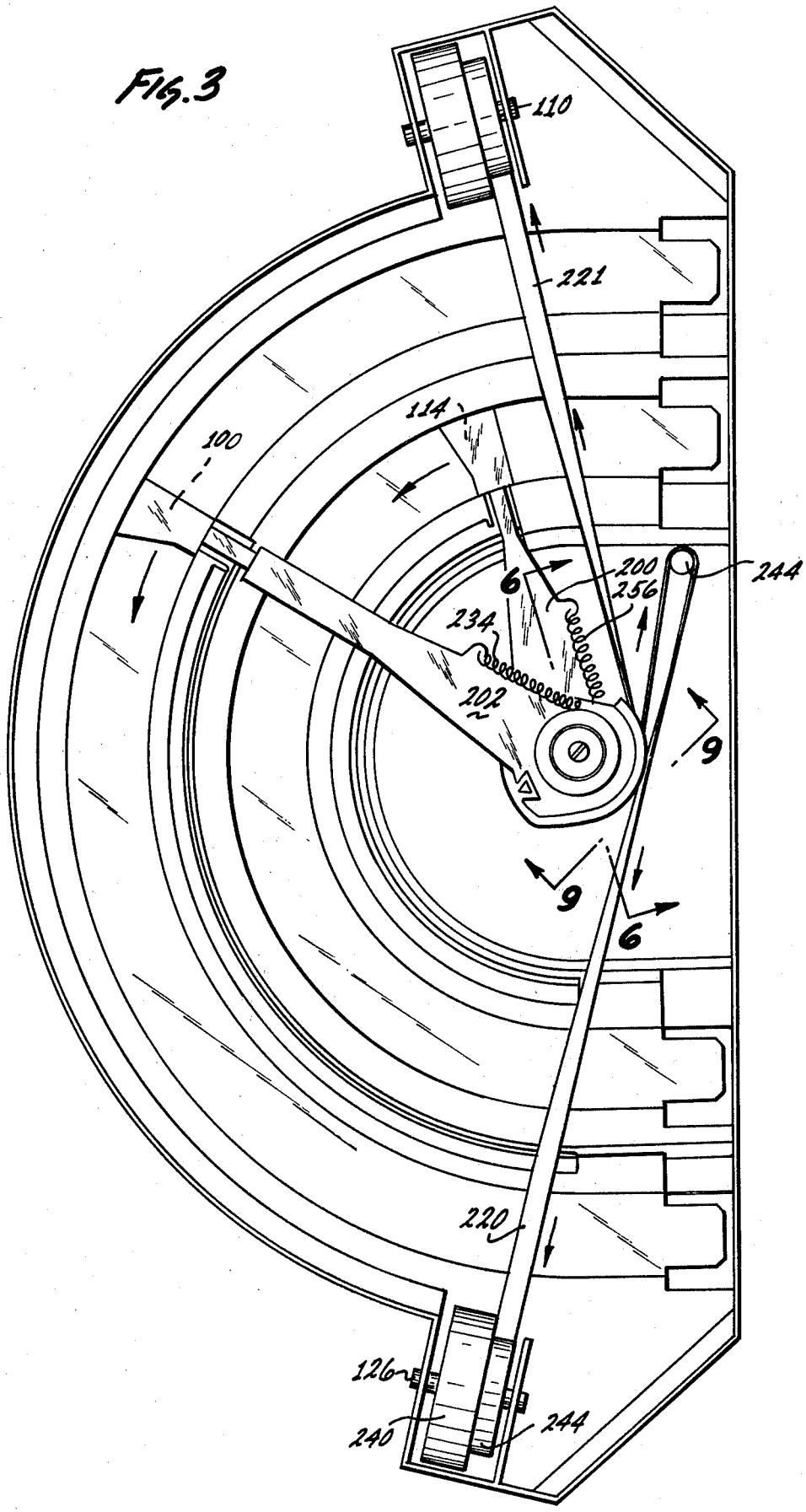
FIG. 3 is a bottom view of the apparatus shown in FIG. 2.
Figure 4:
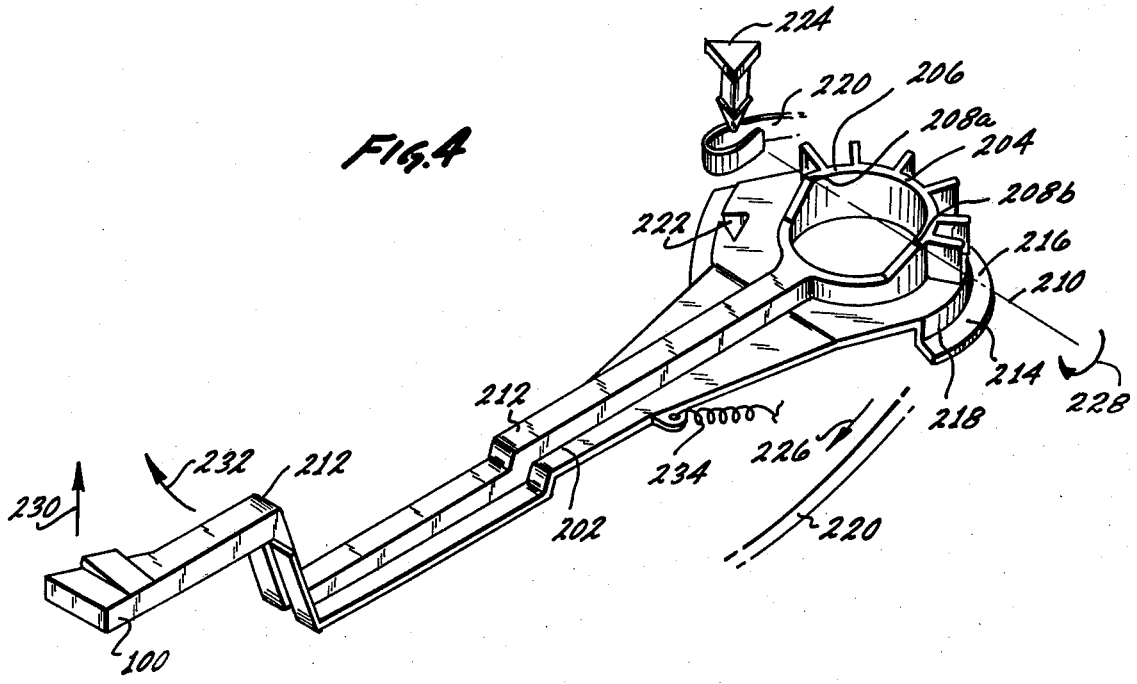
FIG. 4 is an enlarged perspective view of one of the propulsion arms of the propulsion device shown in FIGS. 2 and 3.
Figure 5:
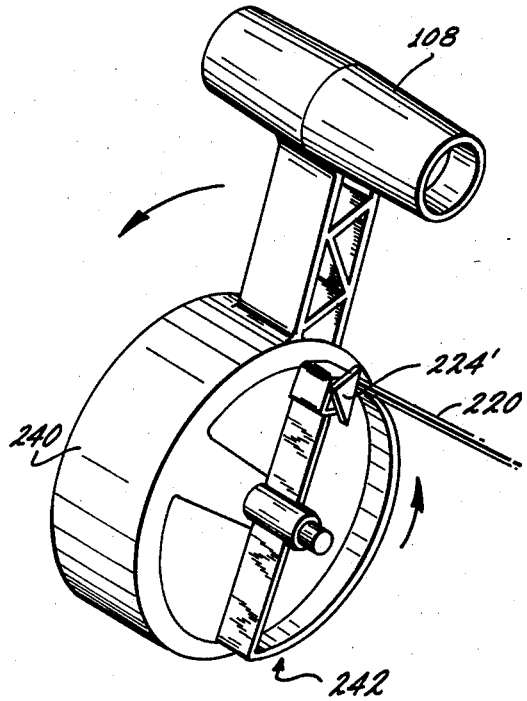
FIG. 5 is an enlarged perspective view of one of the driving arms of the propulsion device shown in FIGS. 2 and 3.

Referring now to FIGS. 1 and 2, curve 20 includes a housing 74 having a top wall 76, an encompassing, depending side wall 78 and an open bottom 80. Top wall 76 forms a running surface for cars 24, 26 and is divided into lanes 82, 84 by upstanding guide walls 86, 88 and 90. Ends 36 of track sections 30, 32 are connected to housing 74 by connecting tabs 92, 94, respectively, and ends 52 of track sections 48, 50 are connected to housing 74 by tabs 96, 98, respectively.

Propulsion device 28 includes a first vehicle-engaging member 100 protruding from a generally horizontal, arcuate slot 102 provided in side wall 88 between lanes 82 and 84 and having an enlarged upstream end 104, said slot extending generally horizontally along said lane 82 to a downstream slot end 106. Vehicle-engaging member 100 is normally maintained at end 104 of slot 102 in a depression 105 in lane 82 by a structure to be hereinafter described. This structure is connected to an operating lever 108 which is swingably mounted on housing 74 by a pin 110, operating lever 108 provides the actuating force for moving member 100 from its normal position at end 104 upwards and into the path-of-travel of vehicle 24 as lever 108 is swung in the direction of arrow 112, as is illustrated in FIG. 1.

Propulsion device 28 also includes a second vehicle-engaging member 114 (not visible in FIG. 1) substantially identical to first member 100 and protruding from a second arcuate slot 116 having an upstream end 118 extending through an opening 120 in guide wall 90 adjacent upstream end 40 of curve 22, and is normally maintained in a depression 121 provided in top surface of lane 84 in the vicinity of slot upstream end 118. Member 114 may be moved from the position shown in FIG. 2 to a position for engagement with vehicle 26 by swinging a lever 122 in the direction of arrow 124. Lever 122 is swingably mounted on housing 74 by a pin 126.

Also shown in FIGS. 1 and 2 is a transparent housing 128 which may make provision for vehicle braking means and which gives additional structural rigidity to housing 74.

Referring now generally to FIGS. 3–9, it may be seen that there are provided two propulsion arms, an upper arm 200 associated with inner track surface 84 and inner slot 116 to which the second vehicle engaging member 114 (not visible in FIG. 3) is appended and a lower propulsion arm 202 associated with outer track 82 and outer slot 102 to which the first vehicle propulsion member 100 is appended. Arm 202 (see FIG. 4) comprises in addition to vehicle engaging member 100, an inner hub portion 204 having an upper surface 206 which together with the adjacent horizontal surface of housing 74 defines a fulcrum at points 208A and 208B, said points defining an axis 210 generally perpendicular to the extended portion of arm 212. Arm 202 also comprises an outer hub portion 214 having a flange 216 and a vertical circumferential drum surface 218. A drive tape 220 is wrapped about said drum surface and may be fastened to an appropriately shaped aperture 222 in the outer hub by means of a tape fastener 224, which may be of the type disclosed in a separate application entitled "Tape and Fastening System", Ser. No. 665,022, filed Feb. 3, 1976, Robert Ford Dyer and Nicholas De Anda, inventors, assigned to the same assignee as is the present invention. It should be noted in particular that circumferential drum surface 218 is offset from axis 210 through said fulcrum points **208*a* and 208*b* so that when tension is applied to tape 220 in the direction indicated by the arrow 226, torque is exerted about axis 210 in the direction shown by the arrow 228 resulting in an upwards movement of vehicle engaging member 100 as indicated by arrow 230, in addition to the rotation of the arm as indicated by arrow 232. A return spring 234** is also provided.

Attached to the other end of tape 220 by another suitable tape fastener 224' is a driving hub 240 which carries the handle 108 mentioned previously with respect to FIGS. 1 and 2. Hub 240 also has a circumferential drum surface 242 but said surface unlike surface 218 is horizontal, the transition from horizontal to vertical being accommodated by flexible tape 220 as is clearly shown in FIG. 3, which figure also showing a post 244 about which said tape passes on its way from arm 202 to driving hub 240.

Figure 6:
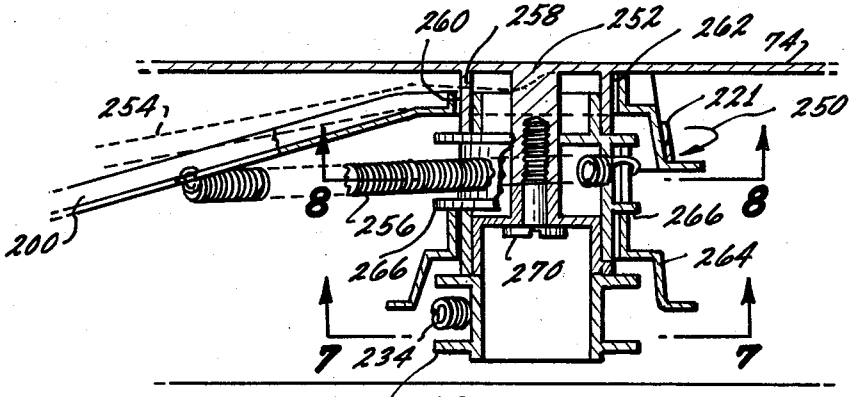
FIG. 6 is an enlarged, partial cross-sectional view of the propulsion arms mounted on their shaft taken along line 6—6 of FIG. 3.
Figure 7:
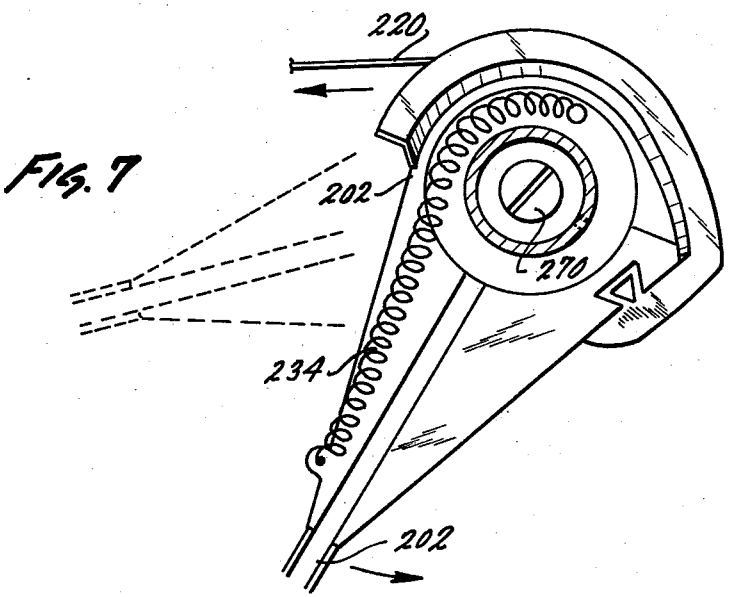
FIG. 7 is a plan and cross-sectional view of the lower arm mounted on its shaft looking upward from the plane defined by line 7—7 of FIG. 6.
Figure 8:
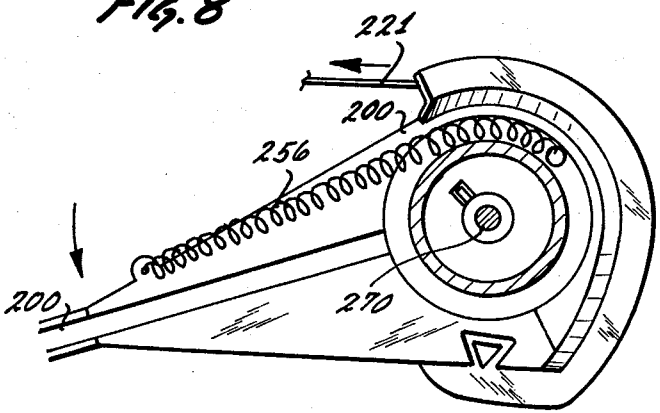
FIG. 8 is a plan and cross-sectional view of the upper arm mounted on its shaft looking upward from the plane defined by line 8—8 of FIG. 6.
Figure 9:
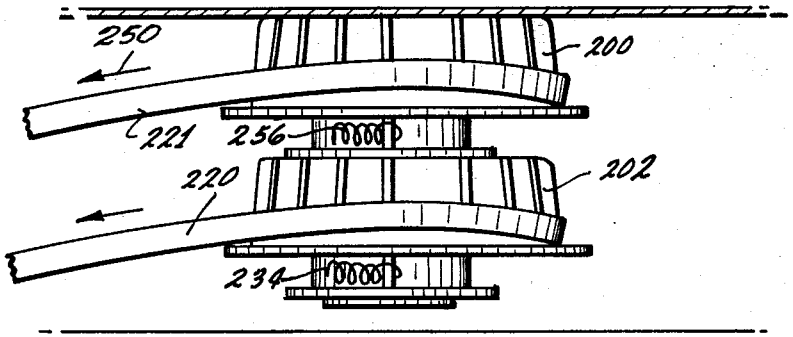
FIG. 9 is an enlarged, partial cross-sectional view of the propulsion arm hubs taken along 9—9 of FIG. 3, and then inverted.

The aforesaid upwards motion of arm 200 may be seen more clearly in FIG. 6. The force exerted on tape 221 in the direction indicated by the arrow 250 produces a tilting motion about the fulcrum at point 252, thereby causing arm 200 to assume the position indicated by the dashed line at 254 against the counterforce produced by coil spring 256 (which is also offset from the axis defined by fulcrum point 252). It should be noted that there is a sloppy fit between the inner hub portion of arm 200 and the shaft 258 about which it rotates, resulting in the space there between indicated by 260. Still referring to FIG. 6, it may be seen that lower arm 202 also has its hub 264 mounted about shaft 258, surface 266 being provided for the action of the fulcrum points **208*a* and 208*b*. Lower arm 202 is similarly mounted about said shaft with a sloppy fit such that it is also capable of moving upwards upon the application of tension to tape 220. Both upper and lower hubs are held in place on shaft 258, as are upper spring retainer 266 and lower spring retainer 268, by means of fastening screw 270**.

While the particular vehicle-racing game apparatus herein shown and described in detail is fully capable of attaining the objects and providing the advantages hereinbefore stated, it is to be understood that it is merely illustrative of the presently preferred embodiment of the invention and that no limitations are intended to the details of construction or design herein shown other than as defined in the appended claims which form a part of this disclosure.

Whenever the term "means" is employed in these claims, this term is to be interpreted as defining the corresponding structure illustrated and described in the specification or the equivalent of the same.

What is claimed is:

1. An improved toy vehicle propulsion system for providing propulsion impulses by means of an external vehicle engaging member to a toy vehicle, said system comprising:

a rotatably mounted driving hub;

a handle attached to said driving hub for imparting rotational impulses to said driving hub;

a circumferential drum surface provided as part of said driving hub and co-axial therewith;

a drive tape having one end thereof attached to and a portion generally disposed about said drum surface;

a vertical shaft extending from a generally horizontal surface; and a propulsion arm rotatably mounted about said vertical shaft, said arm comprising:

an inner hub portion which together with said horizontal surface defines a fulcrum immediately adjacent the intersection of said vertical shaft and said horizontal surface, said arm being free to rock in a vertical plane about said fulcrum;

an outer hub portion defining a generally vertical circumferential drum surface vertically displaced from said fulcrum, the other end of said drive tape being fastened to said outer hub portion and a portion of said tape being generally disposed about said vertical drum surface; and a vehicle engaging member provided at the end of said arm remote from said inner and outer hub portions, whereby an actuating impulse applied to said handle by a child-user is translated into a vertical and arcuate motion of said vehicle engaging member into and along the path of travel of a toy vehicle to be propelled.

2. The system of claim 1 wherein said outer hub portion vertical circumferential drum surface is provided with a lower flange for retaining said drive tape.

3. The propulsion system of claim 1 supplemented by a second such system associated with a second toy vehicle, the vertical shaft of said propulsion system being co-axial with the vertical shaft of said second such system.

4. The supplemented system of claim 3 wherein the drive tape of said second such system has its direction reversed by means of a vertical post.

5. The system of claim 1 further comprising a spring means for causing said vehicle engaging member to be normally positioned out of the path of travel of said toy vehicle.

6. The system of claim 5 wherein said spring means comprises a coil spring attachedly disposed between said arm and said shaft vertically remote from said fulcrum.

* * * * *